US006948251B2

(12) United States Patent
Jebe et al.

(10) Patent No.: US 6,948,251 B2
(45) Date of Patent: Sep. 27, 2005

(54) PIVOTING SHARPENING DEVICE FOR PENCIL WITH NON-CIRCULAR CROSS SECTION

(75) Inventors: Arnim B. Jebe, Weston, CT (US); William C. Lamson, Huntington, CT (US)

(73) Assignee: System K, Inc., Ridgefield, CT (US)

( * ) Notice: Subject to any disclaimer, the term of this patent is extended or adjusted under 35 U.S.C. 154(b) by 111 days.

(21) Appl. No.: 10/611,603

(22) Filed: Jul. 3, 2003

(65) Prior Publication Data

US 2005/0000099 A1 Jan. 6, 2005

(51) Int. Cl.[7] ..... B43L 23/00
(52) U.S. Cl. ..... 30/452; 30/457
(58) Field of Search ..... 30/451, 452, 454, 30/457, 453; 144/28.11

(56) References Cited

U.S. PATENT DOCUMENTS 2,982,253 A * 5/1961 Herbold ..... 30/461
3,659,637 A * 5/1972 Condon ..... 30/454
3,851,687 A * 12/1974 Jones ..... 30/451
4,081,010 A 3/1978 Galli
4,759,129 A 7/1988 Alpha
4,918,816 A 4/1990 Alpha
4,961,451 A 10/1990 Bucci
5,077,903 A 1/1992 Kreim
6,092,293 A * 7/2000 Donaldson ..... 30/457
6,338,198 B1 * 1/2002 Rolls ..... 30/452
6,574,875 B2 * 6/2003 Lawson et al. ..... 30/461
6,725,549 B2 * 4/2004 Jebe et al. ..... 30/452

* cited by examiner

*Primary Examiner*—Hwei-Siu Payer
(74) *Attorney, Agent, or Firm*—McCormick Paulding & Huber LLP

(57) ABSTRACT

A sharpening device for a carpenter's pencil. A housing has a pivotable guide with a cruciform passage to receive the pencil in either of two positions. A pair of oppositely directed blades are mounted on opposed walls within the housing. The pencil is pivoted while sliding it through the guide to obtain a selected sharpened profile on the end of the pencil.

6 Claims, 4 Drawing Sheets

PIVOTING SHARPENING DEVICE FOR PENCIL WITH NON-CIRCULAR CROSS SECTION

BACKGROUND OF THE INVENTION

This invention relates to sharpening device, and more particularly to a sharpening device for an elongated object with non-circular cross section, such as a carpenter's pencil.

Most pencil sharpening devices currently in use are designed for making round tapered points on pencils having cross-sections, which are either circular or in the shape of a regular polygon, generally hexagonal. This typical geometry, such as round or hexagonal, is not compatible with the rectangular lead pencils used by many professionals, including the well-known carpenter's pencil. It is desirable that carpenter's pencils be sharpened to create a selected profile rather than a point. The wooden sheath around the pencil lead is also non-circular, e.g., rectangular, with narrow edges and wide edges oriented at right angles to one another.

Existing pencil sharpening devices which are suitable for circular or hexagonal cross-sections are usually constructed to require a rotational movement of blades around the axis of the pencil being sharpened. This type of mechanical action will not create the desired profile for a carpenter's pencil. As a consequence, the user is reduced to manually shaving or scrapping the carpenter's pencil to provide the desired profile.

A number of authors have suggested sharpening devices especially designed for pencils of rectangular or non-circular cross-sections. These are listed as follows:

| U.S. Pat. No. | Inventor | Issue Date | Title |
|---|---|---|---|
| 4,081,010 | Galli | Mar. 28, 1978 | Pencil Sharpener for Non-circular Section Pencils |
| 4,759,129 | Alpha | Jul. 26, 1988 | Pencil Sharpener |
| 4,918,816 | Alpha | Apr. 24, 1990 | Pencil Sharpener |
| 4,961,451 | Bucci | Oct. 09, 1990 | Sharpener for Rectangular Pencils |
| 5,077,903 | Creim | Jan. 7, 1992 | Carpenter's Pencil Sharpener |

The foregoing devices generally require rotary cutter assemblies which are mounted or manipulated so as to accommodate the irregular cross-section of the carpenter's pencil. They involve complicated and expensive mechanisms.

A commercial pencil sharpener for a carpenter's pencil is manufactured by Penshar LLC, which is manually rotated. However, this sharpener puts a conical end on the carpenter's pencil.

It would be desirable to have a sharpening device which will sharpen or shape wooden or similar non-metallic elongated objects having radially non-symmetrical cross-sections. It would also be desirable to have a low cost sharpening device especially adapted to sharpen a carpenter's pencil and provide a selected profile. It would also be desirable to have a low cost manually operated sharpening device for carpenter's pencils.

Accordingly, one object of the present invention is to provide a low cost sharpening device for carpenter's pencils.

Another object of the invention is to provide a sharpening device for lead pencils of non-circular cross-sections or similar elongated objects which will sharpen or shape one end of the object to a desired profile.

SUMMARY OF THE INVENTION

Briefly stated the invention comprises apparatus for sharpening an elongated object so as to obtain a selected projected profile on one end of the elongated object, the elongated object having a uniform cross section along an object axis. The apparatus comprises a housing defining a recess having an opening and having a pair of convergent walls within the recess, a guide member pivotably mounted on the housing about a pivoting axis, the guide member defining a passage therethrough. The passage is shaped and dimensioned to receive the elongated object and to guide the object for longitudinal motion along the object axis between the convergent walls when manually actuated by a user, and at least one blade having a cutting edge and disposed on at least one of the opposed walls with the cutting edge extending into the recess, whereby the elongated object may be pushed through the passage of the guide toward the convergent walls while the elongated object is also being used to pivot the guide member to move the end of the elongated object past the cutting edge of the blade, so as to sharpen the elongated object to obtain the selected profile.

Preferably the convergent walls define an arcuate recess, the arcuate recess being defined by a generatrix having the shape of the selected projected profile moving with a fixed radius from the pivoting axis.

DRAWINGS

These and many other objects of the invention will be better understood by reference to the following description, taken in connection with the accompanying drawing, in which.

Figure 1:
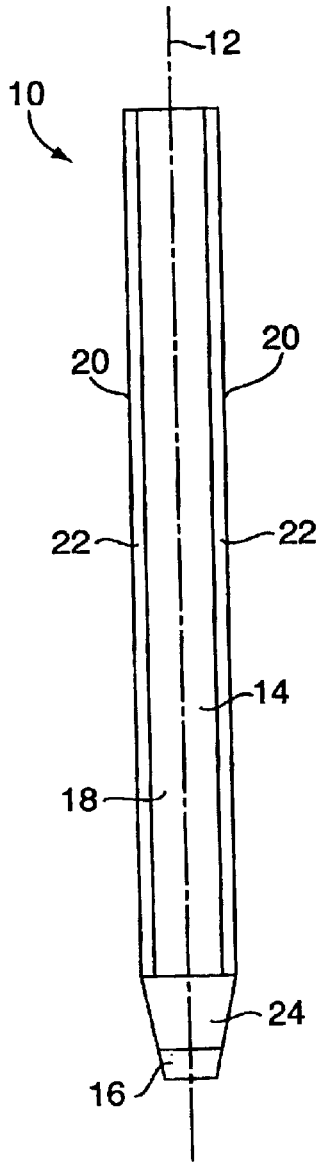
FIG. 1 is a front elevation view of a sharpened carpenter's pencil.
Figure 2:
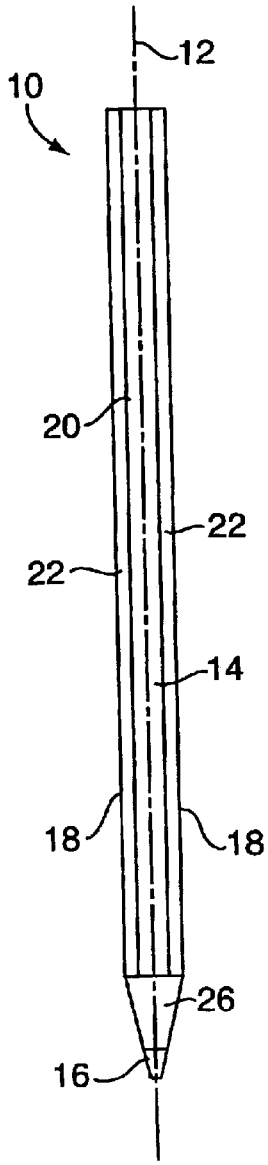
FIG. 2 is a side elevational view of the sharpened carpenter's pencil.
Figure 3:
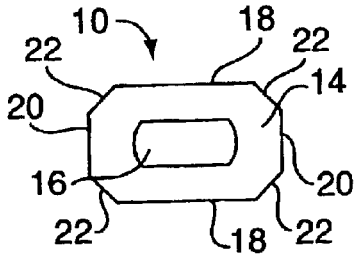
Figure 4:
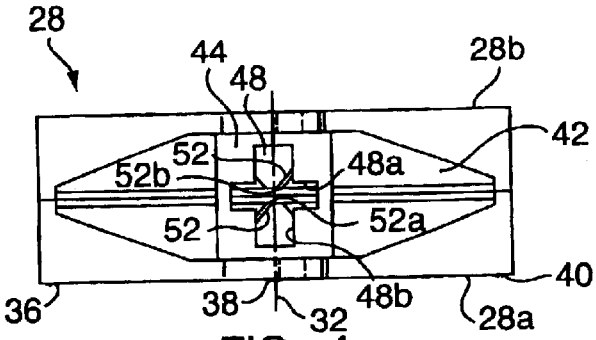
Figure 5:
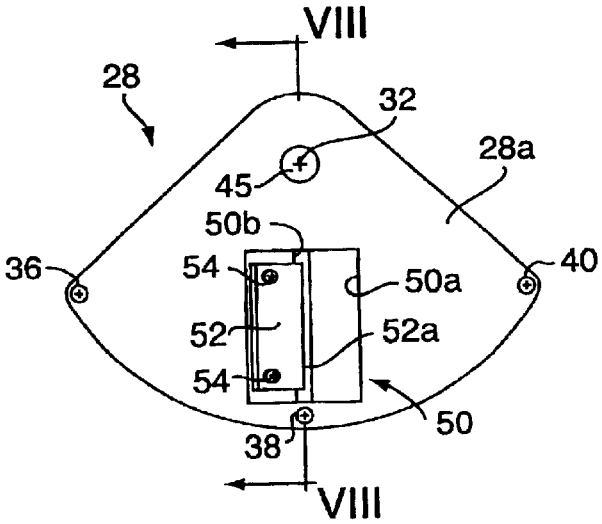
Figure 6:
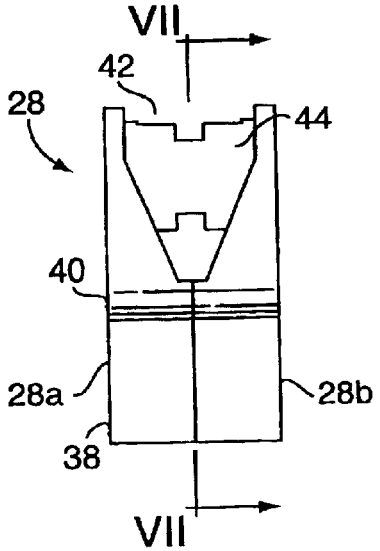
Figure 7:
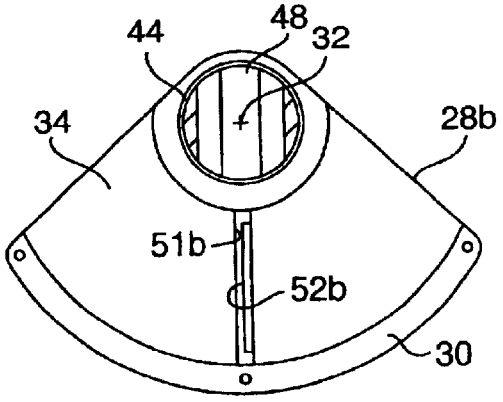
Figure 8:
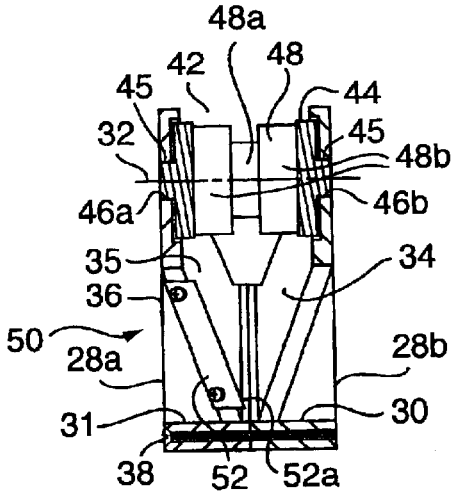
Figure 9:
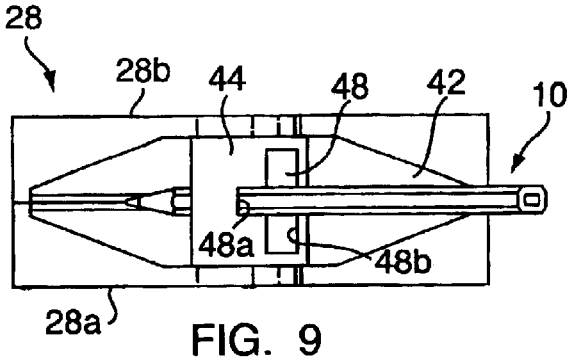

FIG. 3 is an enlarged top plan view of the carpenter's pencil of FIGS. 1 and 2, FIG. 4 is a top plan view of a sharpening device according to the present invention, FIG. 5 is a front elevational view of the sharpening device, FIG. 6 is a side elevational view of the sharpening device, FIG. 7 is a front elevational view of the sharpening device, partly in cross section, taken along lines VII—VII of FIG. 6, FIG. 8 is a side elevational view, partly in cross section, taken along lines VIII—VIII of FIG. 5, FIGS. 9–13 depict the same views of the same sharpening device of FIG. 4 through FIG. 8 respectively, except that an elongated object is added shown in one rotated position in the process of being sharpened, FIGS. 14 through 18 show the same views of the same sharpening device of FIG. 4 through FIG. 8 respectively, except that the same elongated object has been added in a different rotated position in the process of being sharpened.

DETAILED DESCRIPTION OF THE INVENTION

FIGS. 1, 2 and 3 illustrate a carpenter's pencil 10 sharpened on one end to achieve a selected profile. While the invention is primarily intended to provide a sharpened end on a carpenter's pencil, the invention may be utilized with any elongated object of material capable of being sharpened with a blade and having a uniform cross section along an object axis 12. As shown in FIG. 3, the carpenter's pencil comprises a wooden sheath 14 around a lead core 16 of substantially rectangular cross section. As seen in FIG. 3, the carpenter's pencil 10 has a non-circular cross section with oppositely disposed wide sides 18 and oppositely disposed narrow sides 20 separated by chamfered surfaces 22. The desired profile, viewed looking at the wide side in FIG. 1 is an isosceles trapezoid 24. The desired profile viewing the narrow side 20 in FIG. 2 is either a narrow isosceles trapezoid or an isosceles triangle 26.

Referring to FIGS. 4–8 of the drawing, the sharpening device, according to the preferred embodiment of the invention comprises a housing shown generally as 28, which is preferably, but not necessarily, made up of two identical joining halves 28*a*, 28*b*. As seen in FIG. 7, the housing half 28*b* is roughly in the shape of one-quarter of a circle with an arcuate flange 30 formed about a pivoting axis 32 and an adjacent sloping interior wall 34. The other housing half 28*a*, as seen in the cross-section view of FIG. 8, is identical and also has a circular flange 31 and an adjacent sloping wall 35. The two adjacent halves are assembled by means of screws 36, 38, 40 passing through the flanges 30, 31 to join the housing halves together. When the two halves are joined, they define a recess in housing 28 with an opening 42 at the top. The interior walls 34, 35 are convergent toward one another reaching their narrowest distance apart at flanges 30, 31. It is not necessary that walls 34, 35 intersect one another; they approach until they almost intersect.

A guide member 44 is rotatably mounted in the housing 28 on pins 45 in bearing journals 46*a*, 46*b* in the respective halves 28*a*, 28*b*. Guide member 44 is arranged to pivot in the housing about the pivoting axis 32. Guide member 44 defines a passage 48 through the guide member 44. Preferably passage 48 is of a cruciform cross section, with a portion 48*a* extending at right angle to a portion 48*b*, so that it will accept the carpenter's pencil 10 in either of two rotated positions. However, the shape of passage 48 is immaterial so long as it is of uniform cross section permitting the elongated object to slide through the passage 48 toward the convergent walls 34, 35.

Each of the housing halves 28*a*, 28*b* have a blade opening through the wall. This opening is shown generally as 50 on the half 28*a*. Blade opening 50 leads from a wide rectangular entrance 50*a* on the outside, leading to a narrow rectangular exit 50*b* in the inside wall into the recess. A sharpening blade 52 is mounted on the sloped surface between 50*a*, 50*b* with its cutting edge 52*a* extending slightly into the recess. Blade 52 may be secured by any suitable means such as screw 54.

Referring to FIG. 7, the corresponding exit 51*b* is seen with a blade cutting edge 52*b* protruding into the recess beyond the convergent wall 34.

OPERATION

The operation of the invention will best be understood by reference to FIGS. 9–13 showing the carpenter's pencil 10 being sharpened in one rotated position, and FIGS. 14–18 showing the carpenter's pencil 10 being sharpened when it is positioned in the other rotated position. The reference numbers in FIGS. 9–13 and 14–18 correspond to those in FIGS. 4–8.

Figure 10:
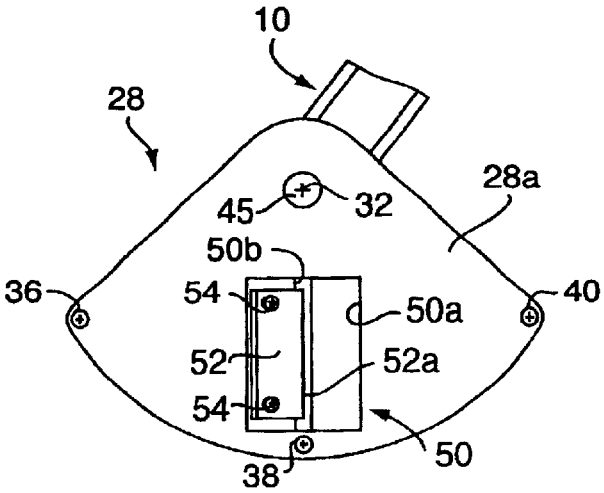
Figure 11:
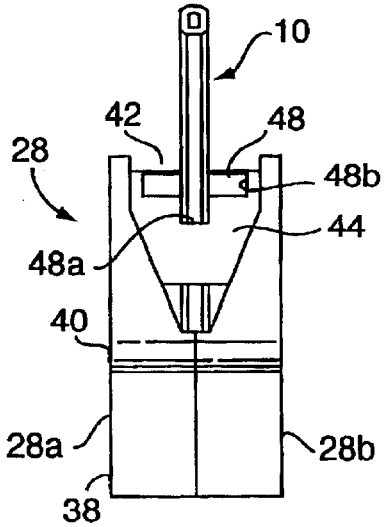
Figure 12:
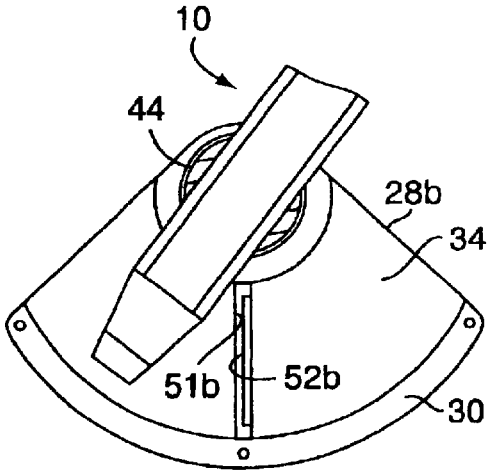
Figure 13:
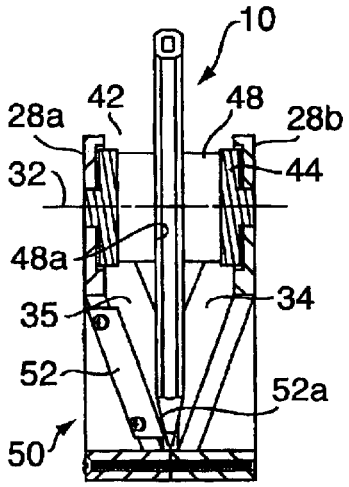
Figure 14:
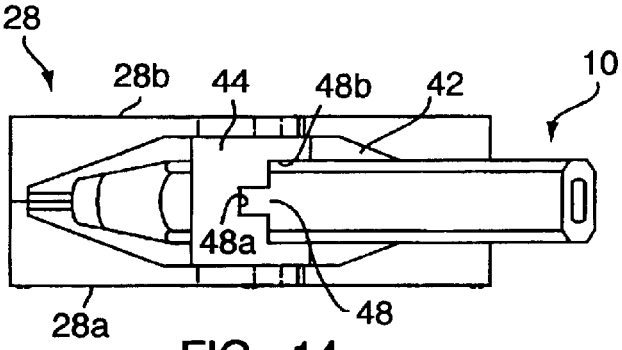

In FIGS. 9–13, the pencil 10 is placed in portion 48*a* of cruciform passage 48. Pencil 10 is grasped by a user and used to pivot the guide member 44 back and forth around the pivoting axis 32, while also maintaining pushing pressure to cause the pencil 10 to slide toward the convergent walls 34, 35 as material is removed. Reference to FIG. 12 shows the guide member 44 being pivoted in a counterclockwise direction so that the cutting edge 52*b* removes material to achieve the selected profile on the end of pencil 10. When the pencil 10 is pivoted in the opposite direction, material is removed on the other side of the pencil by the cutting edge 52*a* of blade 52 (FIG. 10).

Figure 15:
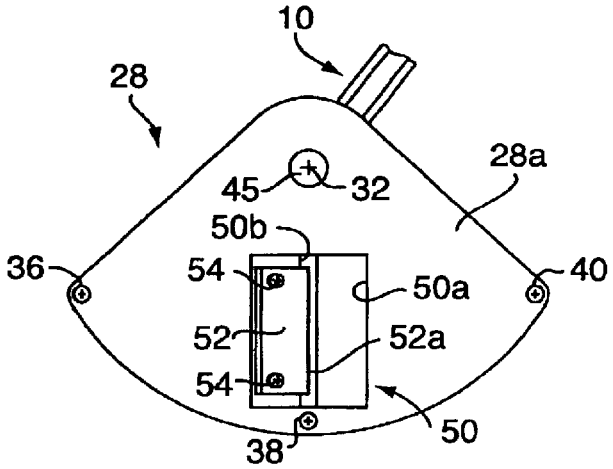
Figure 16:
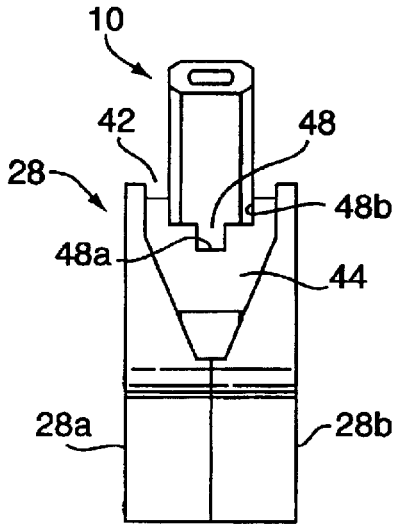
Figure 17:
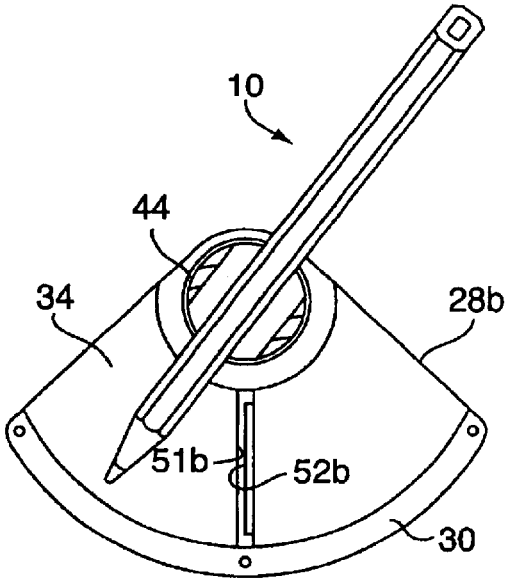
Figure 18:
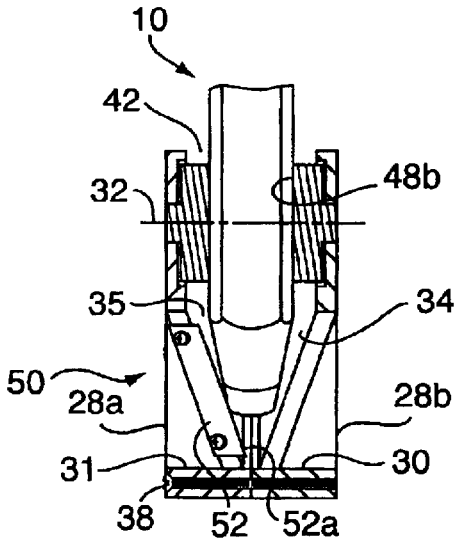

In a similar manner, referring to FIGS. 14–18, the pencil 10 is placed in portion 48*b* of cruciform passage 48. Pencil 10 is now disposed in a position rotated about its axis with the narrow sides of the pencil facing the convergent walls. The guide member 44 is pivoted back and forth by means of pencil 10 while pressure is maintained. FIG. 17 illustrates material being removed from pencil 10 as it is pivoted in a counterclockwise direction. When it is pivoted in the opposite direction, material is removed from the other side of the pencil by the cutting edge 52*a* (FIG. 15).

While the blade opening 50 and blade 52 are disposed in a radial direction from the pivoting axis 32, the blade and opening may also be disposed at an angle to a radial direction to achieve different cutting characteristics.

It will be observed that the portion of the recess between convergent walls 34, 35 where the cutting action takes place is arcuate and generated by a generatrix in the shape of an isosceles triangle moving with a fixed radius about the pivoting axis. The blade edges are straight and extend into the recess in opposite directions, so that material is removed from one side of the elongated object as it is pivoted in one direction and removed from the other side of the object as it is pivoted in the opposite direction. During this time, the object slides through the passage of the guide member, until the desired profile is achieved.

What is claimed is:

1. Apparatus for sharpening an elongated object so as to obtain a selected profile on one end of the elongated object, said elongated object having a uniform cross section along an object axis, said apparatus comprising:

a housing defining a recess having an opening and having a pair of opposed walls, a guide member pivotably mounted in said housing recess about a pivoting axis, said guide member defining a passage therethrough, said passage being shaped and dimensioned to receive the elongated object and to guide the object for longitudinal motion along the object axis between said opposed walls when manually actuated by a user, at least one blade having a cutting edge and disposed on at least one of said opposed walls with the cutting edge extending into the recess at an angle to said object axis, whereby the elongated object can be slid through the passage of the guide member toward the cutting edge of the blade while the elongated object is also being used to pivot said guide member so as to move the end of the elongated object past the cutting edge of the blade, whereby material is removed from the elongated object to obtain said selected profile.

2. The sharpening apparatus according to claim 1, wherein a blade is disposed on each of said opposed walls, each of said blades being disposed with its cutting edge facing in the opposite direction from the cutting edge of the other blade, whereby material is removed from one side of the elongated object as it is pivoted in one direction and removed from the other side of the object as it is pivoted in the opposite direction.

3. The sharpening apparatus according to claim 1, wherein the passage in said guide member has a cruciform cross-section adapted to accept a carpenter's pencil in either of two rotated positions, wherein the material can be removed from the elongated object in either of the two rotated positions about said object axis.

4. The sharpening apparatus according to claim 1, wherein the housing is made up of two identical joining halves, each, including a respective one of said opposed walls and wherein said pair of opposed walls are convergent toward one another.

5. The sharpening apparatus according to claim 4, wherein each of said opposed walls defines a blade opening therethrough, and wherein a blade is disposed on each of said opposed walls with its cutting edge extending through a respective blade opening, each of said blades being disposed with its cutting edge facing in the opposite direction from the cutting edge of the other blade, whereby material is removed from one side of the elongated object as it is pivoted in one direction and removed from the other side of the object as it is pivoted in the opposite direction.

6. Apparatus for sharpening an elongated object so as to obtain a selected profile on one end of the elongated object, said elongated object having a uniform cross section along an object axis, said apparatus comprising:

a housing defining a recess having an opening and having a pair of opposed walls, said pair of opposed walls being convergent toward one another, a guide member pivotably mounted in said housing recess about a pivoting axis, said guide member defining a passage therethrough, said passage having a cruciform cross-section adapted to accept a carpenter's pencil in either of two rotated positions, and being shaped and dimensioned to receive the elongated object and to guide the object for longitudinal motion along the object axis between said convergent walls when manually actuated by a user, a pair of blades each having a cutting edge, each of said blades disposed on a respective one of said opposed walls with its cutting edge extending into the recess at an angle to said object axis, each of said blades also being disposed with its cutting edge facing in the opposite direction from the cutting edge of the other blade, whereby the elongated object can be slid through the passage of the guide member toward the cutting edges of the blades while the elongated object is also being used to pivot said guide member so as to move the end of the elongated object past the cuffing edges of the blades to remove material from one side of the elongated object as it is pivoted in one direction and from the other side of the object as it is pivoted in the opposite direction to obtain said selected profile.

* * * * *

UNITED STATES PATENT AND TRADEMARK OFFICE

CERTIFICATE OF CORRECTION

PATENT NO. : 6,948,251 B2
DATED : September 27, 2005
INVENTOR(S) : Arnim B. Jebe and William C. Lamson It is certified that error appears in the above-identified patent and that said Letters Patent is hereby corrected as shown below:

Column 6,
Line 20, "cuffing" should read -- cutting --.

Signed and Sealed this

Twentieth Day of December, 2005

JON W. DUDAS
*Director of the United States Patent and Trademark Office*